United States Patent [19]

Odham

[11] 3,999,407

[45] Dec. 28, 1976

[54] EMBOSSED STRIPED ELASTIC WARP KNIT FABRIC AND METHOD OF MAKING SAME

[75] Inventor: Carl J. Odham, Asheboro, N.C.

[73] Assignee: Stedman Corporation, Asheboro, N.C.

[22] Filed: Apr. 1, 1975

[21] Appl. No.: 563,953

[52] U.S. Cl. ..... 66/193

[51] Int. Cl.[2] ..... D04B 23/08; D04B 23/10

[58] Field of Search ..... 66/190–195

[56] References Cited

UNITED STATES PATENTS

| | | | |
|---|---|---|---|
| 2,153,645 | 4/1939 | Schonfeld | 66/192 |
| 2,435,897 | 2/1948 | Newman | 66/193 |
| 2,936,603 | 5/1960 | Lewine | 66/193 |
| 3,077,758 | 2/1963 | Skilano | 66/192 |
| 3,258,941 | 7/1966 | Formenti | 66/193 |
| 3,314,251 | 4/1967 | Bunger | 66/193 |
| 3,570,482 | 3/1971 | Emoto et al. | 128/150 |
| 3,625,029 | 12/1971 | Safrit et al. | 66/172 E |
| 3,710,599 | 1/1972 | Sarmiento et al. | 66/193 |
| 3,728,876 | 4/1973 | Richard | 66/192 |
| 3,740,974 | 6/1973 | Bourgeois | 66/193 |
| 3,834,193 | 9/1974 | Wilkens | 66/195 |
| 3,835,512 | 9/1974 | Piller et al. | 28/72 FT |

OTHER PUBLICATIONS

Paling, "Warp Knitting Technology," Columbine Pres, England, pp. 80–90, 93–94, 144–148, 168–174, 338–340.

*Primary Examiner*—Ronald Feldbaum
*Attorney, Agent, or Firm*—Pennie & Edmonds

[57] ABSTRACT

A warp knit fabric having an embossed-appearing broken or interrupted strip on one side wherein the fabric comprises a plurality of base yarns each knitted in successive courses to form a plurality of successive closed loops extending in a warp direction to form an individual wale. A filler yarn extends across a side of the fabric to connect adjacent wales and an elastic yarn is laid into each wale. At least one wale has a pattern or color yarn knitted therein to form a plurality of open loops for a number of successive courses and then is laid in the same wale for a number of successive courses wherein the knitted portion of the pattern yarn overlies the knitted base yarn portion of the same wale to give an embossed broken or interrupted stripe effect.

6 Claims, 2 Drawing Figures

EMBOSSED STRIPED ELASTIC WARP KNIT FABRIC AND METHOD OF MAKING SAME

BACKGROUND OF THE INVENTION

A warp knit elastic fabric used as belting for undergarments and the like has been previously knitted in which the fabric has broken or interrupted color or pattern stripes on one side. Such prior art fabric comprises a plurality of base yarns which are knitted in closed loops to form a plurality of individually warp-extending wales which are connected on a back side of the fabric by a weft-extending filler yarn contained within the loops and which extends across the width of the fabric. An elastic yarn is laid into each individual wale to provide stretch properties to the fabric. A broken or interrupted striped effect in such fabric is obtained by laying color or pattern yarns into particular wales formed by the base yarn and then masking or overlying portions of the pattern yarns by weft-extending filler yarns on the pattern side of the fabric (that side of the fabric on which the stripe is to appear). These weft-extending yarns are contained in the closed loops of the base yarn and also serve to connect adjacent wales together. This construction requires that at least two weft-extending filler yarns be used on the pattern side of the fabric. A first filler yarn extends from one lateral side of the fabric to an edge of the wale containing the pattern yarn in those courses where the pattern yarn is unmasked and then over that wale in those courses where a pattern yarn is masked. A second filler yarn extends from the opposite lateral side of the fabric to the edge of the wale containing the pattern yarn. The overall effect is that a weft-extending filler yarn extends over the complete pattern side of the fabric except where a pattern yarn is unmasked.

In the event that two or more interrupted patterned stripes are to be produced, the first weft-extending filler yarn extends to the edge of one wale containing the pattern yarn in those courses where the pattern yarn shows in wales and then extends over the two or more wales containing the pattern yarn to the end of the second weft-extending filler yarn in those courses where the pattern yarn is masked. With this construction there is an absense of a weft-extending filler yarn between the adjacent pattern portions of the wales containing the pattern yarn as well as those portions of the pattern yarn unmasked with the result that an additional filler material must be included between the stripes in an attempt to prevent the fabric from bunching or curling when in the relaxed state. This is accomplished by laying or knitting in an additional yarn in the wales separating the adjacent color portions of the two colored stripes.

The prior art fabric described has not altogether been satisfactory because among other things the use of two rather than one weft-extending filler yarn on the pattern side of the fabric as well as additional filler yarns between the pattern stripes results in additional yarn ends requiring additional creel space to accommodate the extra yarns and at the same time requiring additional attention of the operator in setting up the machine and of tying yarn ends together. A still further deficiency of this prior art fabric is that the contrast between the unmasked pattern yarn and the remainder of the fabric is not as sharp and clear as may be desired. This is because there is no plating of the pattern yarn with respect to the base yarn forming the wale into which the pattern yarn is laid and also because only the weft-extending filler yarn is available for masking the pattern yarn.

It is therefore an object of the invention to provide for a warp knitted elastic fabric which will have a distinct contrast between the patterned or colored yarn portions and the base yarn portions and which will give an embossed appearance to the patterned portion. It is a further object of the invention to provide for a minimum of separate yarns that must be utilized in forming such a fabric in order to minimize set up time for a knitting machine producing the fabric, to reduce the creel space necessary to supply yarns to such a machine, and to reduce the number of operations required of the machine operator. It is a still further object of the invention to provide for a warp knit elastic fabric which will have a minimal tendency to curl or bunch up, and which to the contrary, will lie flat in the relaxed state in order to improve ease of garment manufacture.

GENERAL SUMMARY OF THE INVENTION

Broadly, a warp knit fabric constructed according to the invention has a plurality of base yarns each of which are knitted in successive courses to form a number of closed loops which extend in a warp direction to form an individual wale. An elastic yarn is laid into each wale. At least one side of the fabric has a filler yarn which is laid in to extend in a weft direction in each course and which is contained in the closed loops formed by the base yarn. The weft-extending yarn serves to join adjacent wales together. A pattern yarn is knitted into one of the wales formed by the base yarn for a plurality of courses to form a number of successive open loops extending in a warp direction. The pattern yarn is then laid into the same wale for a number of courses where the procedure is then repeated to form a broken stripe effect on one side of the fabric.

DESCRIPTION OF THE PREFERRED EMBODIMENT

Figure 1:
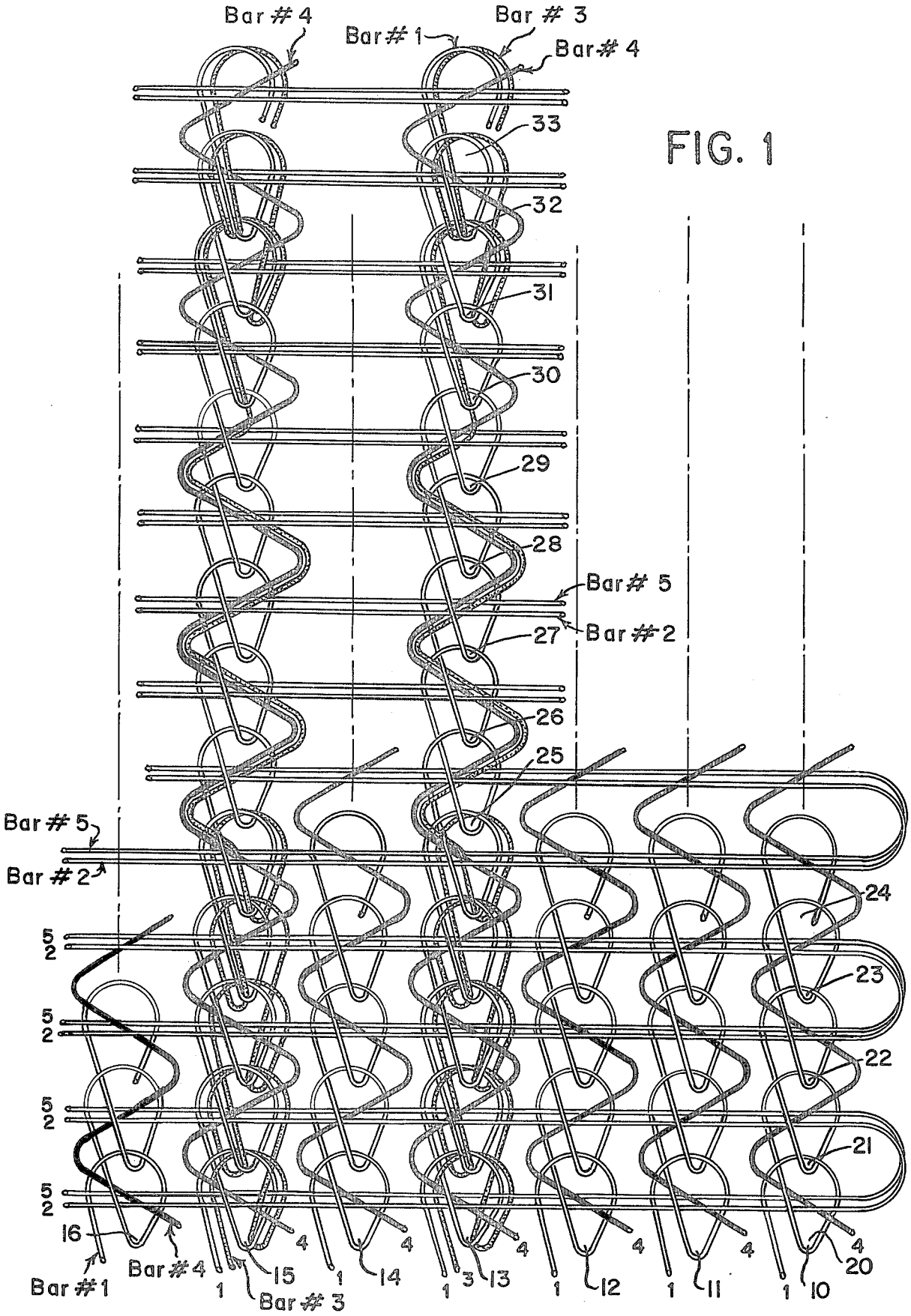
FIG. 1 is a schematic sketch illustrating the preferred stitch configuration of a warp knit elastic fabric made according to the invention.
Figure 2:
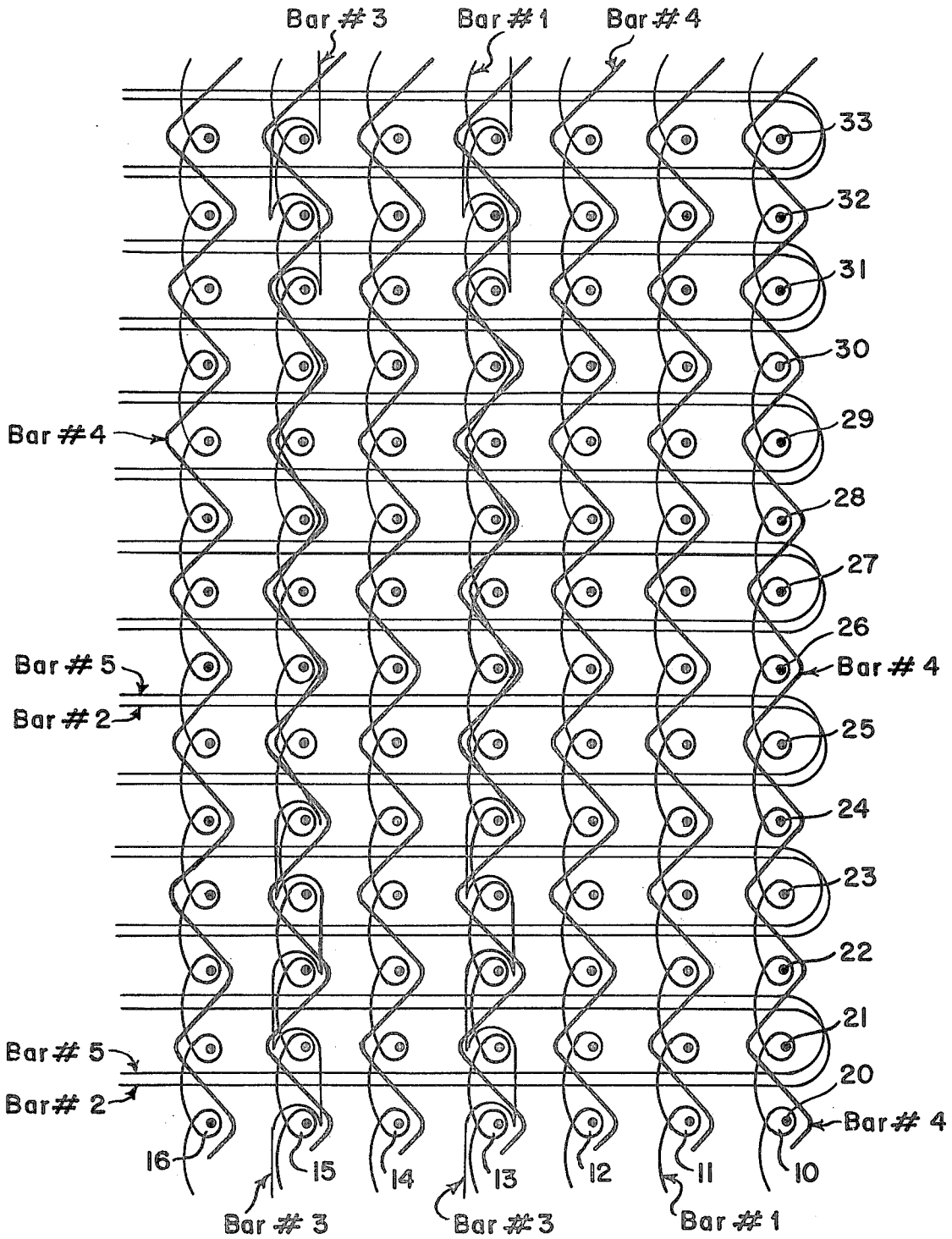
FIG. 2 is a stitch construction diagram of the fabric of FIG. 1 illustrating movement of guide bars utilized in producing the fabric.

Referring to FIG. 1 there is illustrated an elastic warp knit fabric constructed according to the invention which may be produced on a flat bed Raschel type knitting machine having a single needle bar and five guide bars. The fabric comprises a plurality of wales 10–16 each of which is formed by a yarn 1 which is knitted in successive courses 20–33 to form a plurality of successive closed loops extending in a warp direction. The yarn 1 is non-elastic and may comprise a synthetic or natural material. The lapping movement of the yarn 1 about the knitting needles of the machine is controlled by guide bar No. 1 not shown, the movement of which with respect to the knitting needles is illustrated in FIG. 2.

An elastic yarn 4 controlled by a guide bar No. 4 which imparts the stretch characteristics to the fabric is laid into each of the wales formed by the base yarn and may comprise a spandex yarn, a covered rubber yarn or a base rubber yarn, the only requirement being that it expand and contract positively.

The adjacent wales are held together by filler yarns 2 and 5 which are contained within the closed loops formed by the base yarn 1 and which are laid in the fabric by guide bars No. 2 and No. 5. The filler yarns 2 and 5 each extend completely across the width of the fabric in an alternating manner such that both yarns are laid first in one course and then both yarns in an adjacent course and so on. One yarn is laid on the pattern or face side of the fabric and the other yarn is laid on the opposite or back side of the fabric. For simplicity the left end of the fabric is not shown, it being understood that it may extend out any number of wales and it being understood further that the weft-extending yarns are connected in the manner shown on the right end side.

A patterned or colored yarn 3 controlled by a guide bar No. 3 (not shown) is knitted in each of wales 13 and 15 to form a plurality of open loops in courses 20–25 and then is laid in the wales 13 and 15 in courses 26–30 after which it is again knitted into the wales to repeat the pattern. The effect of this stitching and laying in of the pattern yarn is that the pattern yarn will be plated onto the base yarn on one side of the completed fabric (pattern side of the fabric) such that it will completely cover the base yarn as well as the two weft-extending filler yarns and elastic yarn to give an embossed appearance on the pattern side of the fabric. The pattern will be masked or covered over by one of the weft-extending yarns as well as by the closed loops of the base yarn in those courses where it is laid into its wale. The total effect is that there is a clear definite contrast on the pattern side of the fabric between the pattern yarns where they are plated onto the base yarns and where they are covered such as to produce a clear embossed appearing strip made up of a series of warp-extending pattern portions.

FIG. 2 is a stitch diagram illustrating diagrammatically the movement of the various guide bars and the lapping and laying in of the various yarns relative to the knitting needles. By referring to this Figure as well as FIG. 1, it is seen that the direction of lapping of the base yarn 1 is the same about each needle such that identical closed loops are formed. Also it is seen that the direction and lapping of the pattern yarn about the needles alternates to form the open loops.

An advantageous feature of the fabric as illustrated in FIG. 1 is that only two weft-extending filler yarns need be used and both of these extend completely over the width of the fabric produced as contrasted with three weft yarns and unequal distribution of the weft yarns of the prior art fabric. This construction eliminates the need of any filler yarn between adjacent stripes as required in the prior art construction thus eliminating additional yarn ends and subsequent creel space. The fabric produced, also because of the even distribution of the weft-extending yarns over the complete width of the fabric and because there is an elastic yarn in each wale has a minimal tendency to bunch or curl when in the relaxed or unstreteched state thus making its application to garments during garment manufacture easier.

While there is illustrated a particular fabric construction having two pattern wales 13 and 15 separated by an intermediate wale 14 and included within end wales 1 and 7, it is apparent that the novel construction could be utilized in a fabric construction having one or more pattern wales separated by a varying number of intermediate wales. Also it is apparent that the number of courses in which the pattern yarn is stitched and laid into particular wales may vary.

I claim:

1. A warp knit fabric having a front side and a back side comprising a plurality of base yarns each knitted in successive courses to form a plurality of successive closed loops extending in a warp direction to form an individual wale, a first filler yarn extending in a weft direction in each course on one side of the fabric and contained within the closed loops of adjacent wales to connect adjacent wales together, and a pattern yarn contained in at least one wale of the wales formed by the base yarns, said pattern yarn being knitted in said one wale for a plurality of courses to form a plurality of successive open loops extending in a warp direction and then being laid in said one wale for a plurality of courses whereby said pattern yarn will form a striped line overlying the base yarn on the front face of said fabric where it is knitted in said one wale.

2. A warp knit fabric according to claim 1 wherein the direction of the base yarn forming the closed loops in each wale is the same to form identical closed loops and wherein the direction of the pattern yarn forming the open loops in a wale alternates to form alternating open loops.

3. A warp knit fabric according to claim 2 having in addition an elastic yarn laid into each said wale.

4. A warp knit fabric according to claim 3 having in addition a second filler yarn which is overlaid by said first filler yarn and positioned on the opposite side of said fabric than said first filler yarn.

5. An elastic warp knit fabric having front and rear sides comprising a plurality of wales including two end wales separated by two pattern wales and at least one intermediate wale positioned between said pattern wales, each said wale being formed by a base yarn knitted in successive courses to form a plurality of successive closed loops extending in a warp direction, an elastic yarn laid into each said wale, a first filler yarn extending in a weft direction in each course over all of said wales and contained within the closed loops to connect adjacent wales together, a second filler yarn extending in a weft direction in each course under all of said wales and contained within the closed loops to connect adjacent wales together, and a pattern yarn knitted into each said pattern wale for a plurality of courses to form a plurality of successive open loops extending in a warp direction and then laid into the same pattern wale for a plurality of courses whereby each pattern yarn will form a striped, embossed line effect on one face of said fabric where it is knitted in the pattern wale.

6. A method of making an elastic warp knit fabric comprising the steps of knitting each of a plurality of base yarns in successive courses to form a plurality of closed loops extending in a warp direction to form a single wale, laying an elastic yarn into each said wale while each said base yarn is being knitted, laying a filler yarn across the width of the fabric in each course while said base yarn is being knitted whereby said closed loops contain the filler yarn, and knitting a pattern yarn into one of said wales in successive courses to form a plurality of open loops and then laying the pattern yarn into said one wale for a plurality of successive courses whereby the pattern yarn in the courses in which it is knitted will overlie the base yarn in the same courses on one side of the fabric to give an embossed line effect.

* * * * *